United States Patent [19]

Ara

[11] Patent Number: 4,661,002

[45] Date of Patent: Apr. 28, 1987

[54] DOT MATRIX PRINTER

[75] Inventor: Yoji Ara, Yokohama, Japan

[73] Assignee: Canon Kabushiki Kaisha, Tokyo, Japan

[21] Appl. No.: 882,205

[22] Filed: Jul. 3, 1986

Related U.S. Application Data

[63] Continuation of Ser. No. 640,336, Aug. 13, 1984, abandoned.

[30] Foreign Application Priority Data

| | | | |
|---|---|---|---|
| Aug. 19, 1984 | [JP] | Japan | 58-150212 |
| Aug. 19, 1984 | [JP] | Japan | 58-150215 |
| Aug. 19, 1984 | [JP] | Japan | 58-150216 |
| Aug. 19, 1984 | [JP] | Japan | 58-150217 |

[51] Int. Cl.[4] ..... B41J 3/12

[52] U.S. Cl. ..... 400/124; 101/93.05

[58] Field of Search ..... 400/124; 101/93.05; 335/270, 277, 281

[56] References Cited

U.S. PATENT DOCUMENTS

| | | | |
|---|---|---|---|
| 3,896,918 | 7/1975 | Schneider | 400/124 |
| 4,204,778 | 5/1980 | Miyazawa | 400/124 |
| 4,222,674 | 9/1980 | Mori et al. | 101/93.05 X |
| 4,407,591 | 10/1983 | Adamoli et al. | 400/124 |
| 4,453,840 | 6/1984 | Hodne | 400/124 |

FOREIGN PATENT DOCUMENTS

| | | | |
|---|---|---|---|
| 154176 | 12/1980 | Japan | 400/124 |

*Primary Examiner*—Paul T. Sewell

*Attorney, Agent, or Firm*—Fitzpatrick, Cella, Harper & Scinto

[57] ABSTRACT

A dot matrix printer has a vertical array of wires for printing on paper, pivotal armatures having plungers, coils wound around cores, main and auxiliary yokes the latter of which has drawn inner and outer peripheries, and posts at positions of the auxiliary yoke corresponding to the shortest paths of magnetic fluxes generated by the coils. Displacement of the auxiliary yoke upon pivotal movement of armatures is minimized to keep a constant gap between the cores and the plungers and to reduce noise. The reluctance of the magnetic circuit is small to improve magnetic efficiency.

5 Claims, 23 Drawing Figures

DOT MATRIX PRINTER

This application is a continuation of application Ser. No. 640,336 filed Aug. 13, 1984, now abandoned.

BACKGROUND OF THE INVENTION

1. Field of the Invention

The present invention relates to a dot matrix printer which prints in a dot matrix form by striking a recording medium with dot-like striking members.

2. Description of the Prior Art

In order to print a character or the like with dots, n wires arranged vertically at a pitch P2 are shifted m times at a pitch P1 to form an m×n matrix, as shown in FIG. 1. The wires corresponding to the character or the like to be printed are driven upon each shift to print the character or the like.

FIGS. 2 to 5 show a conventional structure of a wire dot head for performing such dot printing.

Referring to FIGS. 2 to 5, a front guide 1 is fixed to an intermediate guide 2. The intermediate guide 2 has screw notches 2*a* for receiving screws for mounting the head on a carriage (not shown).

A flexible printed circuit board 3 formed integrally with a radiating fin plate 4 is arranged behind the intermediate guide 2.

The radiating fin plate 4 also serves as a spacer between the flexible printed circuit board 3 and an elliptical cylinder yoke 5. The radiating fin plate 4 transmits the heat of the yoke 5 to a back holder to be described later and comprises a material having a good thermal conductivity (e.g., an aluminum plate of about 2 mm thickness).

A plurality of cores 6 are fitted in the yoke 5. Bobbins 8 having coils 7 wound thereon are mounted on the respective cores 6.

Two terminals 8*a* are formed for each bobbin 8 and are soldered at one end thereof to the two ends of the coil 7. The other end of each terminal 8*a* is soldered to the flexible printed circuit board 3 through the yoke 5 and the radiating fin plate 4.

A rear guide 9 has an overall cylindrical shape. The rear guide 9 is fitted in the intermediate guide 2 though the yoke 5, the radiating fin plate 4, and the flexible printed circuit board 3.

One end of each return spring 10 is fixed to the rear end of the rear guide 9. The open end of the rear end portion of the yoke 5 is closed with an auxiliary yoke 11. A circular opening is formed at the central portion of the auxiliary yoke 11. The rear end of the rear guide 9 corresponds to the circular opening of the auxiliary yoke 11.

A post 8*b* projecting rearward from the bobbin 8 is fitted in a corresponding through hole formed in the auxiliary yoke 11 to project rearward. The rear end portions of armatures 14 are fitted around the posts 8*b*. The armatures 14 number the same as wires 22. A plunger 13 projects from an intermediate portion of each armature 14.

A spacer 12 is arranged between the auxiliary yoke 11 and the armatures 14.

The spacer 12 is incorporated so as to prevent wear by contact between the auxiliary yoke 11 and the armatures 14 and unstable movement of the armatures 14 due to residual magnetism or the like of the auxiliary yoke 11 upon formation of a closed magnetic circuit.

As shown in FIG. 5, the plurality of armatures 14 extend radially. The proximal end of each wire 22 is fixed to the distal end of the corresponding armature 14. The return spring 10 is elastically mounted between the free end of the armature 14 and the rear end of the rear guide 9. The return spring 10 normally biases the free end of the armature 14 in a direction to separate it from the rear end of the rear guide 9.

A stopper 15 is arranged behind the armatures 14 so as to oppose the free ends of the armatures 14. The stopper 15 is fitted in an armature holder 16. The distal end of each radial arm of the armature holder 16 presses the proximal end of the armature 14 toward the auxiliary yoke 11. The pressing force of each arm of the armature holer 16 against the armature 14 is given by a radial leaf spring 17 arranged behind the armature holder 16. A damper 18 is arranged behind the leaf spring 17. The damper 18 is made of a material having a large specific gravity such as lead and is in contact with a back holder 21 through a washer 19 and a spring washer 20.

In order to provide good heat dissipation for the head, the back holder 21 has a large surface area and has a number of fins on its surface, as shown in FIG. 3.

The back holder 21 is fixed to the intermediate guide 2 with screws 23 and covers a portion including the armature and the yoke.

The damper 18 is kept displaceable by means of the leaf spring 17 and the spring washer 20 so as to provide a vibration-free structure.

The washer 19 prevents forced pressing of the washer 20 into the damper 18.

In order to prevent buckling, the wires 22 are guided by the guides 1, 2 and 9 such that they gradually form a vertical array and terminate in a complete vertical array within the front guide 1.

Printing is performed with the head having the above structure. When the coil 7 is energized in accordance with a printing command, a closed magnetic circuit is formed by the yoke 5, the auxiliary yoke 11, the plungers 13, and the cores 6. Therefore, the plungers 13 are attracted toward the cores 6. The armatures 14 then allow the wires 22 to project a predetermined distance from the front guide 1 against the biasing force of the return springs 10. Then, the wires 22 dot-print through an ink ribbon (not shown) onto a printing paper sheet.

A magnetic circuit of a conventional wire dot head consists of the yoke 5, the core 6, the plunger 13, and the auxiliary yoke 11, as shown in FIG. 6.

With this structure, when only the drive portion of the armatures 14 is considered, the printing force and the response characteristics to an electrical signal depend only upon a gap G between the core 6 and the plunger 13. The gap G is given by:

$$G=H_1+t_1+t_2-H_2-H_3$$

where $H_1$ is the distance between the bottom surface and the end face of the yoke 5, $H_2$ is the height of the core 6, $H_3$ is the height of the plunger 13, $t_1$ is the thickness of the auxiliary yoke 11, and $t_2$ is the thickness of the spacer 12 comprising a polyester film.

As can be seen from FIG. 2, the auxiliary yoke 11 serves as a stopper for the armatures 14 along the printing direction. As is well known, the printing force of the wires which allows copying of 3 to 4 sheets is about 2.5 kg per wire.

Therefore, when all of the plurality of wires 22 are driven at the same time, an extermely large force acts on the side surfaces of the auxiliary yoke 11.

The displacement of the side surface of the auxiliary yoke 11 will be calculated with a model in accordance with the force acting on the side of the auxiliary yoke 11 of the conventional printing head.

As shown in FIG. 7, when the attracting force of each armature 14 is represented by F and the number of wires (the number of armatures) is represented by N, the force $F_T$ acting on the auxiliary yoke 11 due to the N armatures is given by:

$$F_T = NF \quad (1)$$

For the sake of simplicity, the outer and inner diameters of the auxiliary yoke 11 are represented by $D_0$ and $D_1$, and it is assumed that the force $F_T$ acts as an equally distributed weight w on the side surface of the auxiliary yoke 11, as shown in FIG. 8.

As can be seen from FIG. 2, it is assumed that the periphery of the auxiliary yoke 11 is simply supported.

Under these assumptions, the equally distributed weight w (kg/mm$^2$) is given by:

$$w = F_T/((\pi/4)(D_0^2 - D_1^2)) \quad (2)$$

A displacement t at the inner periphery of the auxiliary yoke 11 is given by:

$$t = \alpha_{13} x w D_0^4/Eh^3 = 0.78 \times (wD_0^4/Eh^3) \quad (3)$$

where E is the Young's modulus of the material of the auxiliary yoke, h is the thickness of the auxiliary yoke, and $\alpha_{13}$ is the flexural coefficient. When the ratio $D_1/D_0$ is 0.42, $\alpha_{13}$ is 0.78.

When the distance between the plunger position on the auxiliary yoke 11 to the outer periphery thereof is represented by l, a displacement $t_p$ at the plunger position is given by:

$$t_p 2tl/(D_0 - D_1) \quad (4)$$

When the auxiliary yoke 11 is displaced, a gap $G_2$ between the core 6 and the plunger 13 is given by:

$$G_2 = G_1 t_p \quad (5)$$

where $G_1$ is the gap to when the auxiliary yoke 11 is not displaced.

As can be seen from equation (5) above, $G_2$ can be zero. This corresponds to a case wherein the core and the plunger are in contact with each other.

In such a case, even if the coil is deenergized, the core 6 and the plunger 13 attract each other due to residual magnetism. Therefore, the wire 22 cannot easily project from the front guide. Then, the wire 22 it tightly urged against the ink ribbon, thus resulting in damage to the ink ribbon or the wire 22 itself.

When the above-mentioned structure is adopted, the posts **8*b* of the bobbins 8** prevent an improvement in magnetic efficiency.

The magnetic circuit for driving the wires 22 comprises the cores 6, the yoke 5, the auxiliary yoke 11, and the plungers 13.

Holes **11*a* for receiving the posts 8*b* are formed in the auxiliary yoke 11. The armatures 14 pivot about the posts 8*b* inserted in the holes 11*a***.

The posts **8*b* are formed integrally with the bobbins 8 and are made of a nonmagnetic insulating resin or the like. When the armatures 14 pivot about the posts 8*b*, the posts 8*b* wear at the edges of the holes of the armatures 14 made of iron plates. In the worst case, the posts 8*b* of the bobbins 8** may be so damaged as to prevent further printing.

Furthermore, since the holes **11*a* are formed at a position intermediate in the magnetic path, the magnetic flux is not formed at this portion, as shown in FIG. 9**.

Furthermore, due to the presence of the holes **11*a***, the reluctance is increased, the magnetic efficiency is lowered, and the printing duty cannot be improved above a predetermined level.

In a conventional head having the structure described above, the shape and the arrangement of the core 6 and the plunger 13 prevent a higher density of the wires, a compact wire assembly, and a higher efficiency of the printer.

As shown in FIGS. 4 and 5, the cores 6 each having a circular section are arranged on an elliptical track in the elliptical cylinder yoke 5.

The bobbins 8 are fitted around the cores 6, and the plungers 13 integral with the armatures 14 are fitted inside the bobbins 8.

The plunger 13 also has a circular section as shown enlarged in FIG. 10. Therefore, the plunger 13 together with the core 6 requires a space corresponding to its diameter. For this reason, it is difficult to integrate at high density the cores 6 and the plungers 13, and a compact wire dot head having a large number of pins and an excellent power-printing force converting efficiency cannot be obtained.

Moreover, In the wire dot head having the above-mentioned structure, the presence of the auxiliary yoke 11 results in a high noise. The auxiliary yoke 11 serves as a stopper in the printing direction when the armatures 14 perform the printing operation.

However, since the auxiliary yoke 11 comprises a metal, the auxiliary yoke 11 generates a high noise upon contacting with the armatures 14.

Although the polyester film spacer 12 is interposed between the auxiliary yoke 11 and the armatures 14, it does not provide any substantial noise preventing effect due to its small thickness of 50 $\mu$m.

In the normal printing state, since the entire stroke of the wires 22 is not utilized, the armatures 14 do not contact the auxiliary yoke 11. However, if the platen has a low hardness, the wires 22 are strongly urged against the platen, or if the wires 22 buckle, the auxiliary yoke 11 will contact the armatures 14.

When printing of only one sheet is to be performed with the gap between the platen and the distal end of the head adjusted for printing a plurality of sheets, the armatures 14 contact the auxiliary yoke 11 with a strong force, thus generating a large impact noise.

SUMMARY OF THE INVENTION

It is an object of the present invention to provide a dot matrix printer which can perform dot strike printing with an excellent performance.

It is another object of the present invention to improve magnetic stability and efficiency.

It is still another object of the present invention to improve the mechanical strength upon striking of a striking member.

It is still another object of the present invention to allow stable and efficient operation of the striking means.

It is still another object of the present invention to improve the magnetic efficiency and to provide a compact printer.

It is still another object of the present invention to reduce printing noise.

The above and other objects and features of the present invention will become apparent from the following description taken in conjunction with the accompanying drawing.

BRIEF DESCRIPTION OF THE DRAWINGS

FIGS. 2 through 8 are for explaining the conventional structure of the head, in which:

FIG. 2 is a cross-sectional plan view;

FIG. 3 is an exploded perspective view thereof;

FIG. 4 is a view along the line A—A in FIG. 2;

FIG. 5 is a view along the line B—B in FIG. 2;

FIG. 6 is a diagram of a yoke portion;

FIG. 7 is a front view of an auxiliary yoke, and

FIG. 8 is a representation for explaining the displacement of the auxiliary yoke;

FIGS. 11 to 23 show embodiments of the present invention, in which;

FIG. 11 is a cross-sectional plan view of a first embodiment of the present invention, FIG. 12 is a back view thereof with the back holder being removed, FIG. 13 is a front view thereof, FIG. 14 is a side view thereof, FIG. 15 is a back view of an auxiliary yoke, FIG. 16 is a longitudinal sectional side view of the auxiliary yoke, FIG. 17 is a diagram for explaining the displacement of the auxiliary yoke, FIG. 18 is a front view of an integral assembly of the auxiliary yoke and a subbody, FIG. 19 is a side view of the auxiliary yoke and the subbody, FIG. 20 is a diagram for explaining the flow of magnetic flux, FIG. 21 is a representation for explaining the relationship between the plunger and the gap, FIG. 22 is a front view of another example of the integral assembly of the auxiliary yoke and the subbody according to a second embodiment of the present invention, and FIG. 23 is a side view of the auxiliary yoke and the subbody of FIG. 22.

DETAILED DESCRIPTION OF THE PREFERRED EMBODIMENTS

The preferred embodiments of the present invention will be described below with reference to the accompanying drawings.

Figure 11:
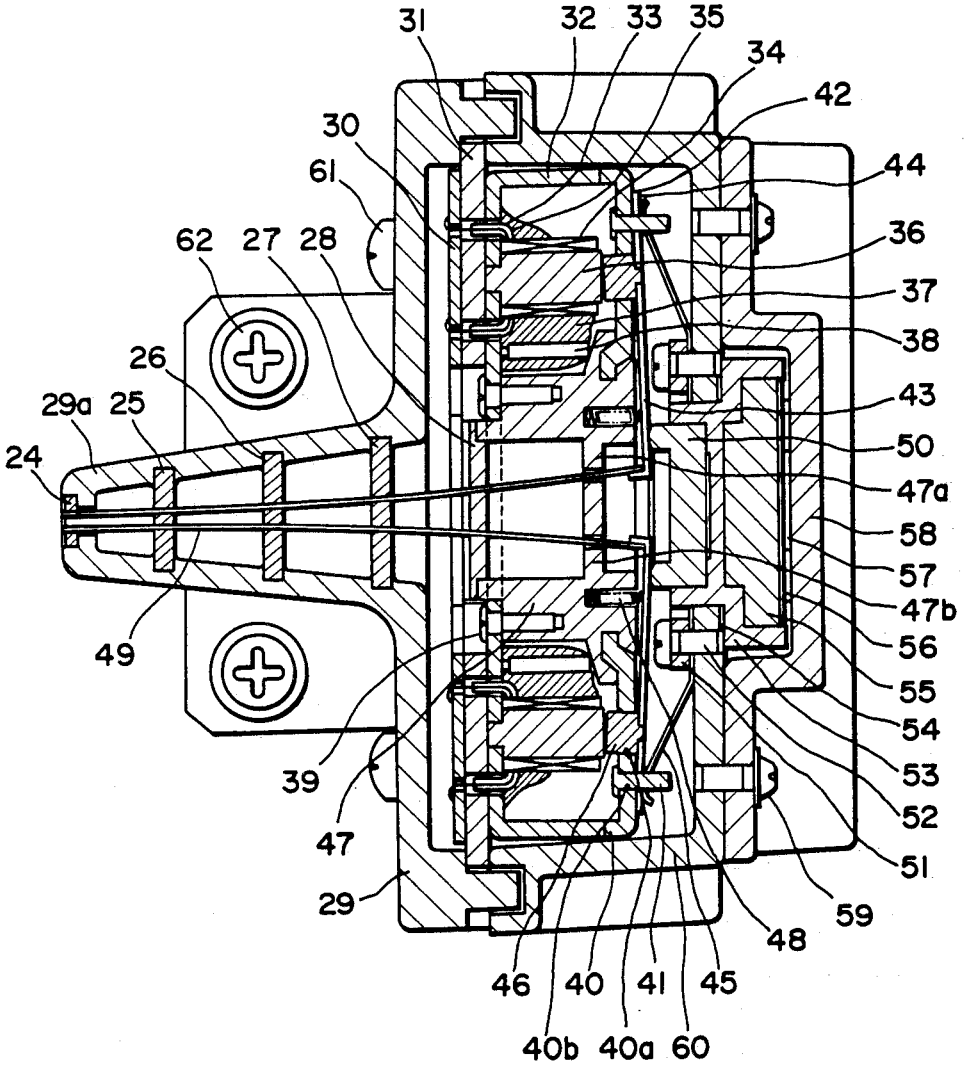

FIGS. 11 to 21 are for explaining the first embodiment of the present invention. FIG. 11 shows a section of a wire dot head of a dot matrix printer according to the embodiment of the present invention.

Referring to FIG. 11, a body 29 is an integral body of supports for front and intermediate guides unlike in the case of a conventional structure. A pluarlity of intermediate guides 25 to 27 are mounted on a projection 29*a* projecting toward the front. A front guide 24 is mounted at the distal end of the projection 29*a*. The intermediate guides 25 to 27 are made of a linear synthetic resin such as carbon fiber reinforced PBT (polybutyrene terephthalate), carbon fiber reinforced nylon, glass fiber reinforced PBT, glass fiber reinforced nylon, Teflon or a mixture thereof.

The front guide 24 is made of a material having a high wear resistance such as ruby, ceramic, glass or a synthetic resin.

A main yoke 32 drawn into a cylindrical shape is housed in the body 29. A spacer 31 also serving as a heat radiating fin plate formed into a ring-like shape is fixed to that side surface of the main yoke 32 which is located at the side of the projection 29*a* of the body 29. A similarly ring-shaped printed circuit board 30 is also fixed to the outer side surace of the spacer 31.

The main yoke 32 has a cylindrical shape, and a circular opening is formed at its center.

Figure 12:
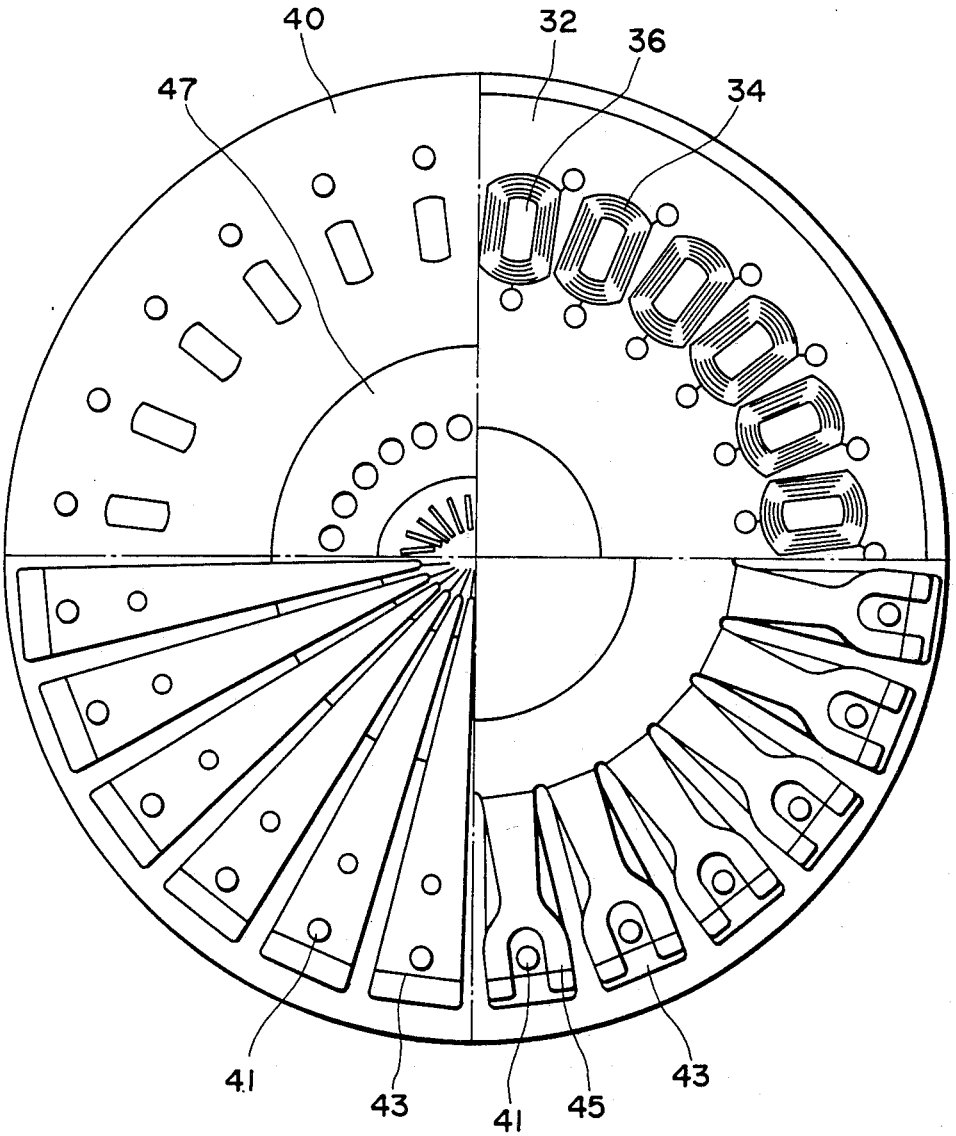
Figure 13:
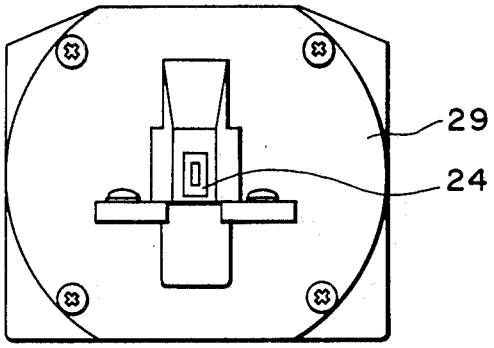
Figure 14:
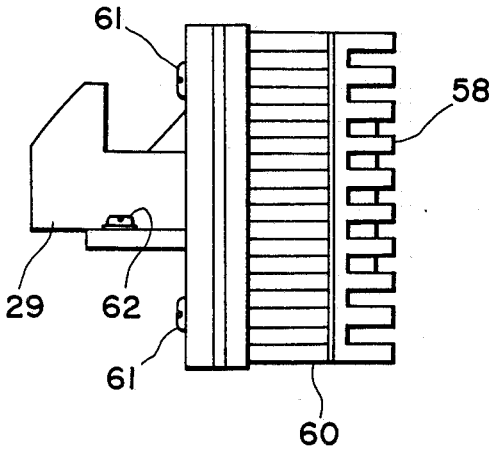

A number of cores 36 (for example, 24) are formed at equal angular intervals on the yoke 32, as shown in FIG. 12. The edge of the yoke 32 and the edge of the cores 36 are polished to be coplanar and to form a uniform gap between the cores 36 and plungers to be described later.

The cores 36 have a sectional shape obtained by cutting two parallel sides of a cylindrical column, as shown in FIG. 12.

Cylindrical coils 34 are fitted outside the twenty-four cores 36. Ends 35 of the coils 34 are soldered to the printed circuit board 30 through the yoke 32 and the spacer 31. The ends 35 are covered with heatresistant insulating columns 33 for preventing shortcircuiting.

In order to prevent disconnection due to head vibration, the coils 34 are fixed to the yoke 32 by an epoxy resin adhesive 37. In order to prevent seizing of the coils 34, thermistors 38 for detecting the temperatures of the coils 34 are buried near the coils 34 and likewise fixed with the adhesive 37.

An auxiliary yoke 40 is fixed to the rear end of the yoke 32. In order to improve flexural rigidity, the outer and inner peripheries of the yoke 40 are bent by drawing. The bent outer edges of the yoke 40 are abutted against the yoke 32. A total of twenty-four posts 41 of a magnetic material project from the auxiliary yoke 40 in one-to-one correspondence with the cores 36.

The rear ends of armatures 43 as rotating means being pivotal about a point are fitted to the posts 41. Plungers 46 are fixed to the intermediate portions of the armatures 43. The plungers 46 are slidably fitted in through holes formed in the auxiliary yoke 40 and oppose the cores 36. The auxiliary yoke 40 is formed into a ring-like shape and made of ferrite-type stainless steel which will not reduce the permeance of the magnetic circuit and which is compatible with the armatures 43 in respect of wear resistance.

A polyester film 42 is interposed between the auxiliary yoke 40 and the armatures 43 so as to prevent wear of these members upon contact with each other and to provide a good magnetic shield between these members.

The central bent portion of the auxiliary yoke 40 having the above construction is integrally formed with a subbody 47 as a frame means by fitting it around the subbody 47. The subbody 47 is formed of a synthetic resin having excellent heat and wear resistance. An intermediate guide 28 is fixed to the distal end of the subbody 47. The subbody 47 and the yoke 32 are fixed with screws 39.

A part equivalent to the subbody 47 has been conventionally made of POM (polyacetal). However, in the present invention, the subbody 47 comprises PBT reinforced with 10% glass fiber. As compared with the conventional subbody, the subbody 47 of the present invention causes little wear of the wire and can provide a head life 1.5 times that of the conventional head.

One end of each of several return springs 48, provided as biasing means, is fixed to the rear end of the subbody 47. The other end of each return spring 48 is pressed to an intermediate portion of the corresponding armature 43. Thus, each armature 43 is biased by the return spring 48 away from the subbody 47. The rear end of a wire 49 as a striking means for dot-printing is fixed to the distal end of each of the total of twenty-four armatures 43. The wires 49 are guided to the front guide 24 through a guide 47*a* formed in the subbody 47 and the intermediate guides 25 to 28.

In this embodiment, twenty-four wires 49 are used in 2 groups; each group of twelve wires 49 is staggered. The pitch of the twenty-four wires 49 is 0.282 mm, and the dot pitch during printing is 0.141 mm.

Each wire 49 has a diameter of 0.20 mm at the distal end and 0.22 mm at the remaining portion thereof, and comprises a tungsten wire subjected to electropolishing.

The plungers 46 fixed to the armatures 43 have elongated sections obtained by cutting two sides of cylindrical columns as in the case of the cores 36, as shown in FIG. 12.

The plungers 46 and the cores 36 are respectively arranged in an arcuate formation such that their longitudinal axes are aligned toward the center of the arc.

A stopper 50 is arranged behind the armature 43. The stopper 50 must have a good heat resistance since it is exposed to high temperature of up to about 150° C. during printing. In order to provide a long life for the intermediate guides, oil is applied between the wires 49 and the intermediate guides. Since the oile is also applied to the stopper 50, the stopper must be resistant to oils and chemicals.

When the armatures 43 are stopped by the stopper 50 after printing, the armatures 43 generally stop after rebounding. High-speed printing is allowed if the time for settling the oscillation of the armatures 43 before they stop is short. Therefore, the stopper must be made of a material having a small impact resilience coefficient. A material satisfying such a requirement is, e.g., fluororubber.

The stopper 50 is fixed to a stopper holder 53 which is slidably fitted in the central portion of a back holder 60 constituting the rear casing of the head.

The back holder 60 covers the overall rear half of the head and is fixed to the body 29 with screws 61.

The back holder 60 has a number of fins so as to externally dissipate the heat generated at the drive portion of the head. The back holder 60 serves another purpose of shielding the outside from the noise generated by the armature 43 striking against the stopper 50 in their return movement.

In order to improve the thermal conductivity of the back holder 60, its surface is treated with black Almite.

A leaf spring holder 51 is fixed to the inner side surface of the back holder 60 with screws 52. A leaf spring 45 is interposed between the leaf spring holder 51 and the back holder 60.

The leaf spring 45 is also formed in a radial form, as shown in FIG. 12, and its distal ends are fixed to the posts 41 so as to urge the proximal ends of the armatures 43 against the auxiliary yoke 40.

The armatures 43 are made of SPCC (cold rolled stainless stell sheet). Therefore, when the armatures 43 move, they wear due to contact with the stainless steel leaf spring 45. This prevents stable operation of the armatures 43. A polyester sheet 44 is interposed between the armatures 43 and the leaf spring 45 in order to prevent this.

A sub-back holder 58 is fixed to the rear side of the back holder 60 with screws 59.

A belleville spring 57 is arranged through a washer 56 between the sub-back holder 58 and a damper 55 fixed to the stopper holder 53. The damper 55 comprises lead and is urged to and fixed on the stopper holder 53.

As has been described above, the stopper holder 53 is slidably fitted around the back holder 60. When the thickness or number of adjust washers 54 fitted between the rear surface of the back holder 60 and the stopper holder 53 is changed, the position of the stopper 50 and the stroke of the wires 49 can both be changed.

In the wire dot head of the present invention having the above-mentioned structure, when the coil 34 corresponding to the wire 49 to be driven during printing is energized, a closed magnetic circuit is formed by the core 36, the yoke 32, the auxiliary yoke 40, and the plungers 46. The plunger 46 and the armature 43 are attracted, and the desired wire 49 is projected to print on a printing paper sheet through an ink ribbon.

As can be seen from FIG. 11, according to the present invention, the peripheries of the auxiliary yoke 40 are bent annularly to provide a higher rigidity.

The displacement of the auxiliary yoke 40 having such a structure is as follows.

Figure 15:
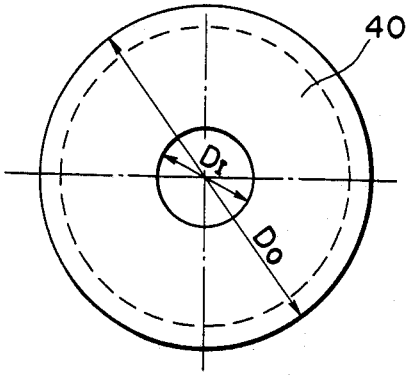
Figure 16:
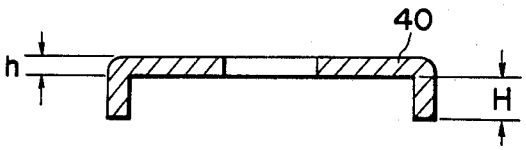
Figure 17:
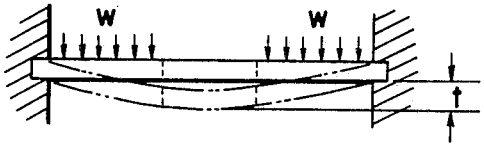
Figure 18:
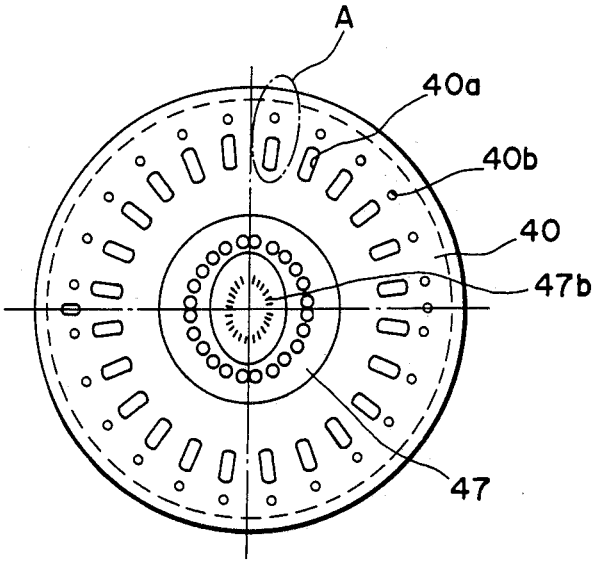

As shown in FIGS. 15 to 17, when the outer diameter of the auxiliary yoke 40 is represented by $D_0$, the inner diameter thereof is represented by $D_1$, the force of one armature acting on the auxiliary yoke 40 is represented by F, and the number of armatures is represented by N, the force $F_T$ acting on the auxiliary yoke 40 is given by:

$$F_T = NF \tag{6}$$

When it is assumed that this force $F_T$ acts as an equally distributed weight w (kg/mm$^2$) on the side surface of the auxiliary yoke 40, as shown in FIG. 17, the weight w is given by:

$$w = F_T/((\pi/4)(D_0^2 - D_1^2)) \tag{7}$$

Since the outer periphery of the auxiliary yoke is drawn by a height H as shown in FIG. 16, the periphery can be considered to be fixed as shown in FIG. 17. Therefore, the displacement t of the inner periphery upon application of the equally distributed weight w on the auxiliary yoke 40 is given by:

$$t = \alpha_{14} x w D_0^4/Eh^3 = 0.1 \times w D_0^4/Eh^3 \tag{8}$$

where E is the Young's modulus of the material of the auxiliary yoke, h is the thickness of the auxiliary yoke, and $\alpha_{14}$ is the flexural coefficient. When the ratio $D_1/D_0$ is set to be 0.42, the coefficient $\alpha_{14}$ is 0.1.

When the distance between the position of the plungers 46 and the outer periphery of the auxiliary yoke 40 is represented by l, the displacement of the auxiliary yoke 40 at the positions of the plungers 46 can be given by:

$$t_p' = 2tl/(D_0 - D_1) \quad (9)$$

When a gap between the cores 36 and the plungers 46 when the auxiliary yoke 40 is not displaced is given by $G_1$, then gap $G_2$ when the auxiliary yoke 40 is displaced is given by:

$$G_2 = G_1 - t_p' \quad (10)$$

When such a structure is adopted, the ratio $\alpha$ of the displacements of the auxiliary yoke of the conventional structure and that of the present invention is given by:

$$\alpha = t_p'/t_p = 0.1/0.78 = 0.129 \quad (11)$$

It is seen from the above equation that the displacement obtained by drawing the peripheries of the auxiliary yoke is reduced to $\frac{1}{8}$ that of the case wherein no such drawing is performed.

If the outer and inner diameters and the thickness of the auxiliary yoke remain the same, drawing of the peripheries of the auxiliary yoke greatly affects the displacement of the auxiliary yoke.

Since the embodiment of the present invention has such a construction as described above and since the outer periphery of the auxiliary yoke is drawn, the flexural rigidity of the auxiliary yoke is improved, and the displacement caused by the acting force of the armature on the auxiliary yoke can be significantly reduced. The gap between the cores and the plungers can then be kept constant, the printing duty can be improved, and high-speed printing can be performed.

Furthermore, since the cores and plungers do not contact each other, unlike in a conventional printer, holding of the plungers by residual magnetism does not occur. The wires will not project, and damage to the wires and the ink ribbon will be prevented.

Figure 19:
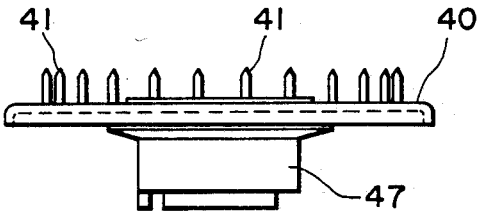
Figure 20:
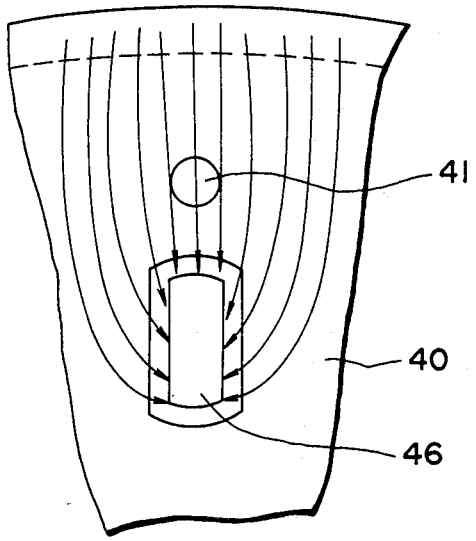

In the embodiment of the present invention, as shown in FIGS. 19 and 20, the post 41 is fitted in the position of the auxiliary yoke 40 corresponding to the shortest path of the magnetic flux generated by the coil 34 toward the plunger 46. Therefore, the reluctance does not increase, unlike in the conventional case, and so the amount of heat generated is descreased, the magnetic efficiency is improved, and the printing duty is improved.

In the embodiment described above, the post is made of a magnetic material. However, to obtain the same effect, a post may comprise a synthetic resin in which a magnetic powder is dispersed. The post is then inserted or pressed into a hole 40*b* of the auxiliary yoke 40.

The subbody 47 is formed integrally with the auxiliary yoke 40. As is apparent from FIG. 23, a side surface 47*c* of the subbody 47 projects slightly beyond the outer side surface of the auxiliary yoke 40.

Therefore, during printing, the armature 43 are not abutted against the metallic auxiliary yoke 40 but contact with the side surface 47*c* of the resin subbody 47 to reduce noise.

Since the embodiment has the above-mentioned structure, excellent effects to be described below are obtained.

The magnetic circuit of the wire dot head having the above structure includes the cores, the yoke, the auxiliary yoke, and the plungers.

The efficiency of the magnetic circuit is determined by the gap between the cores and the plungers and the gap between the auxiliary yoke and the plunger.

The gap between the auxiliary yoke and the plunger will be analyzed below.

In the description to follow, the attracting force of the armature, the gap between the auxiliary yoke and the plunger, and the thickness of the auxiliary yoke are the same as those of the conventional printer.

The attracting forces of the armature and plunger are determined by the sectional area of the plunger. Therefore, the sectional area of the plunger according to the present invnetion is rendered to equal that of the conventional plunger.

Figure 1:
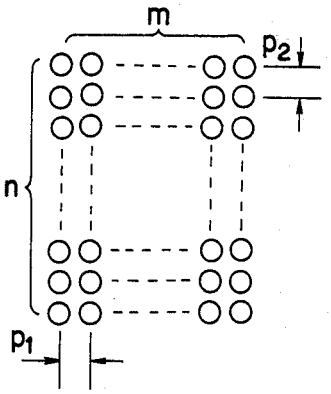
FIG. 1 PRIOR ART
FIG. 1 is a diagram for explaining printing with a wire dot head.
Figure 2:
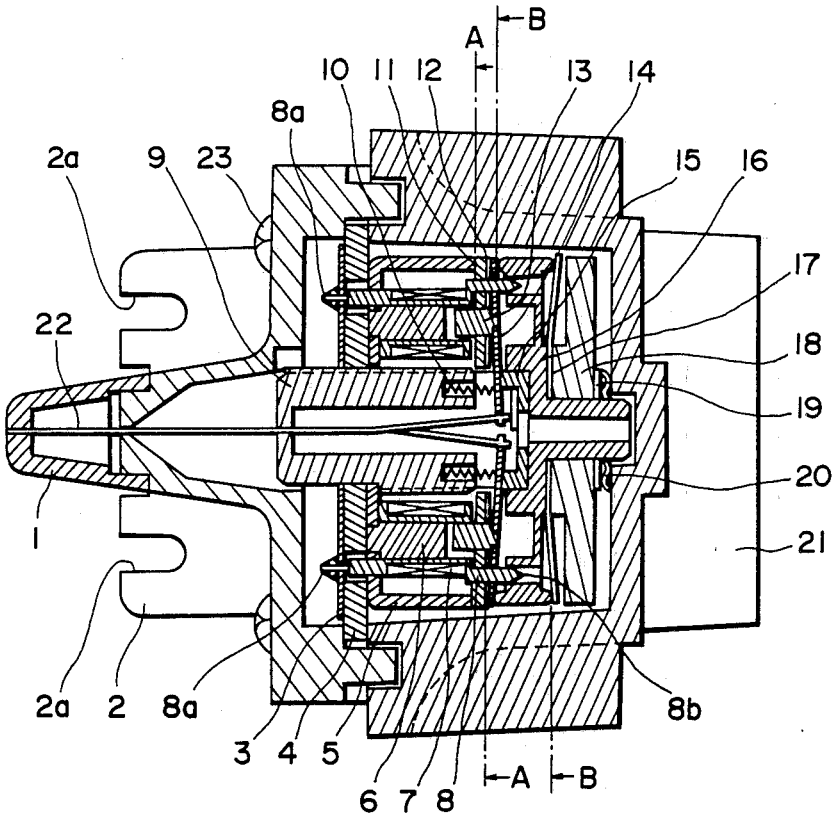
FIG. 2 PRIOR ART
Figure 3:
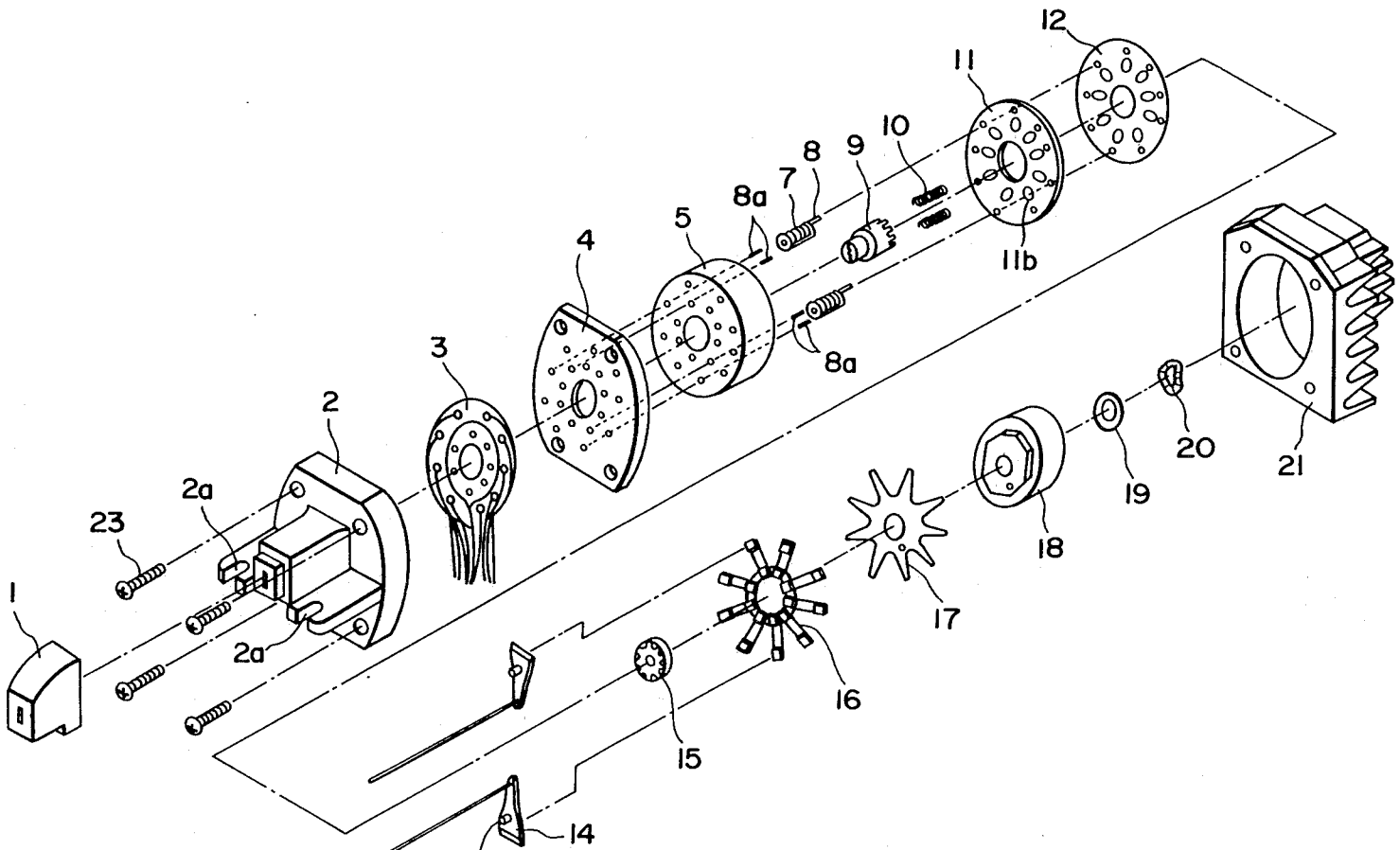
FIG. 3 PRIOR ART
Figure 4:
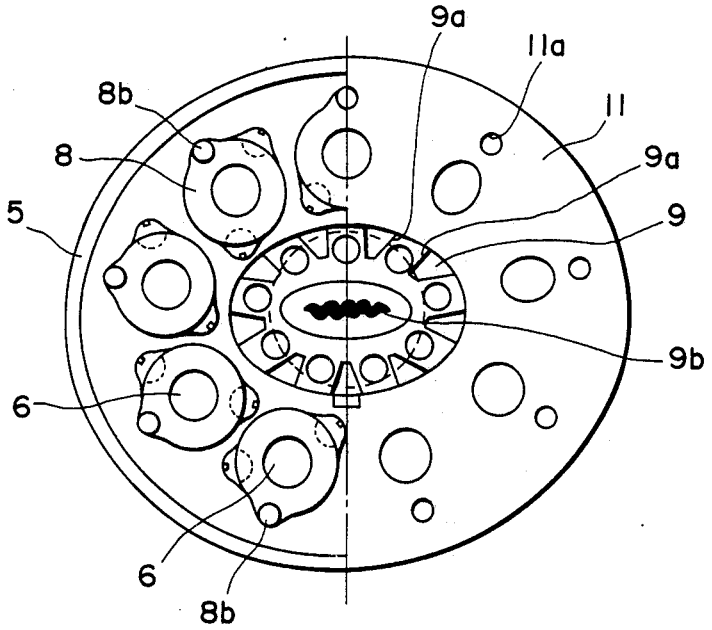
FIG. 4 PRIOR ART
Figure 5:
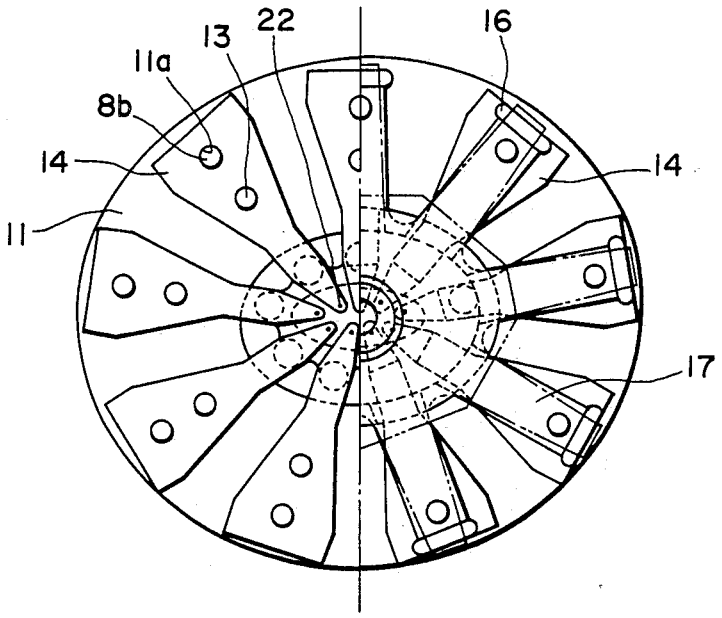
FIG. 5 PRIOR ART
Figure 6:
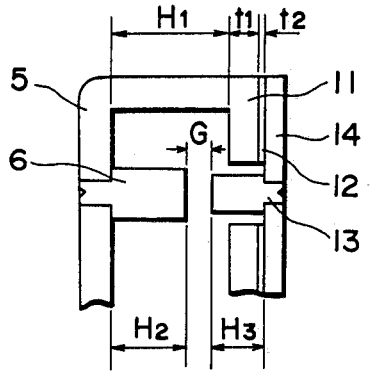
FIG. 6 PRIOR ART
Figure 7:
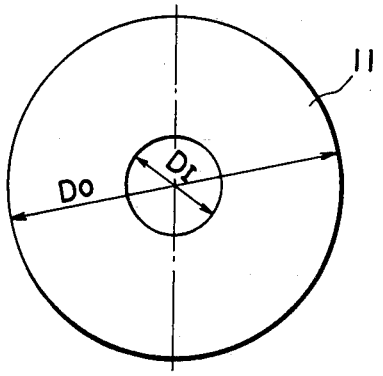
FIG. 7 PRIOR ART
Figure 8:
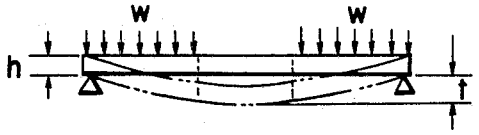
FIG. 8 PRIOR ART
Figure 9:
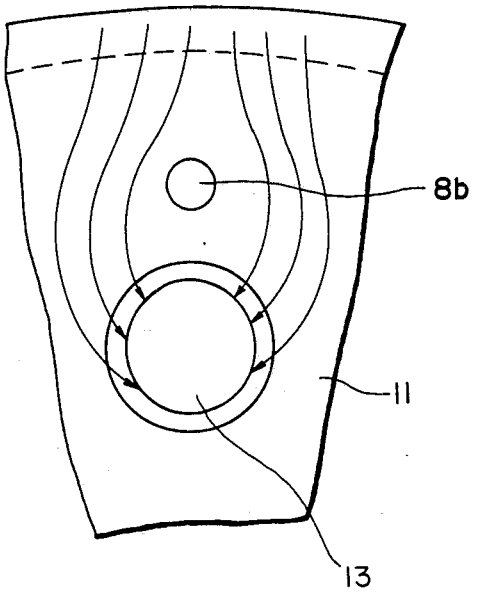
FIG. 9 PRIOR ART
FIG. 9 is a view for explaining the flow of magnetic flux.
Figure 10:
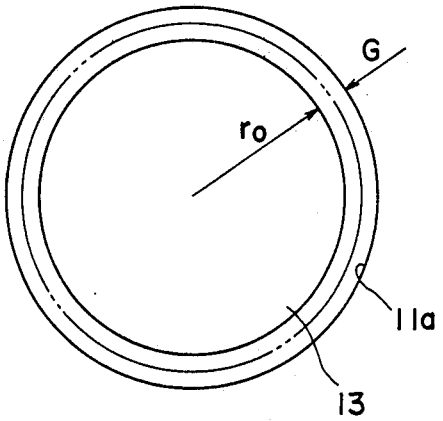
FIG. 10 PRIOR ART
FIG. 10 is a view showing the relationship between a plunger and a gap.
Figure 21:
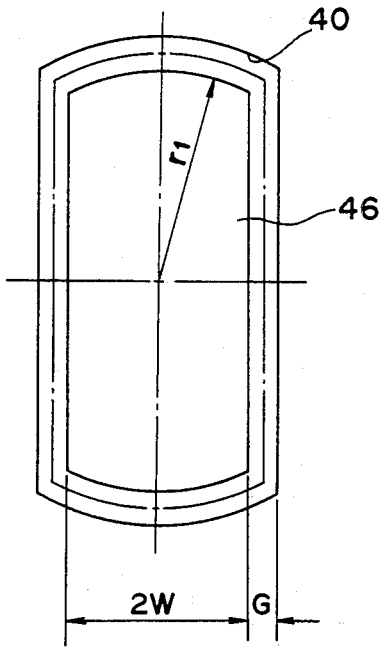

As shown in FIG. 10, the radius of the conventional plunger is represented by $r_0$ and the gap between the plunger and the yoke is represented by G. As shown in FIG. 21, the radius of the plunger according to the present invention is represented by $r_1$, the width thereof is represented by 2w, and the gap between the plunger and the auxiliary yoke is represented by G. Then, since the sectional areas of the two plungers are the same, the sectional area of either plunger can be given by the following equation:

$$\pi r_0^2 = 2\{r_1^2 \cos^{-1}(\sqrt{r_1^2 - w^2}/r_1) + w\sqrt{r_1^2 - w^2}\} \quad (12)$$

Permeance P of each plunger will be calculated below.

When the magnetic permeability of the gap is represented by $\mu$, the opposing area between the plunger and the auxiliary yoke is represented by S, and the gap between the plunger and the auxiliary yoke is represented by G, the permeance as a reciprocal of the reluctance is given by:

$$P = \mu S/G \quad (13)$$

When the permeance of the conventional plunger is represented by $P_0$ and the opposing area between the plunger and the auxiliary yoke is represented by $S_0$, the permeance $P_0$ is given by:

$$P_0 = \mu S_0/G \quad (14)$$

Meanwhile, when the permeance of the plunger of the present invention is represented by $P_1$ and the opposing area between the plunger and the auxiliary yoke is represented by $S_1$, the permeance is given by:

$$P_1 = \mu S_1/G \quad (15)$$

Therefore, when the average value of the opposing areas of the plunger and the auxiliary yoke is calculated as the outer circumferential length of the opposing area between the plunger and the auxiliary yoke, the areas $S_0$ and $S_1$ are given by:

$$S_0 = 2\pi(r_0 + G/2) \times t \quad (16)$$

$$S_1 = t \times [4\sqrt{(r_1 + G/2)^2 - (W + G)^2} + (r_1 + G/2) \times 4 \times \cos^{-1}(\{(r_1 + G/2)^2 - (W + G)^2\}/(r_1 + G/2)^2)] \quad (17)$$

The difference $(P_1 - P_0)$ is given by:

$$P_1 - P_0 = (\mu/G)(S_1 - S_0) > 0 \quad (18)$$

Therefore, $P_1 > P_0$ is established. It is therefore seen that a greater permeance can be obtained with a plunger structure according to the present invention.

It is thus seen that since the reluctance is small, the conversion efficiency of the electrical energy into printing force is high.

The actual permeance will be calculated below.

The permeance $P_0$ of the conventional structure will first be calculated.

Substitution of $r_0 = 1.25$ mm, $r_1 = 1.7$ mm, $G = 0.1$ mm, $T = 1.2$ mm and $\mu = 4\pi \times 10^{-7}$ (Wb/AT, m) in equations (16) and (17) yields $S_0 = 9.80$ (mm$^2$) and $S_1 = 11.60$ (mm$^2$). Thus, $P_0$ can be calculated as:

$$P_0 = (4\pi \times 10^{-7} \times 9.80 \times 10^{-6})/(0.1 \times 10^{-3})$$

$$= 1.23 \times 10^{-7}\ (Wb/AT)$$

$$P_1 = (4\pi \times 10^{-7} \times 11.60 \times 10^{-6})/(0.1 \times 10^{-3})$$

$$= 1.46 \times 10^{-7}\ (Wb/AT)$$

Therefore, the ratio $P_1/P_0 = 1.19$ is obtained. The magnetic efficiency when the present invention is applied, that is, the conversion efficiency of the electrical energy into printing force is improved by about 20%.

Figure 22:
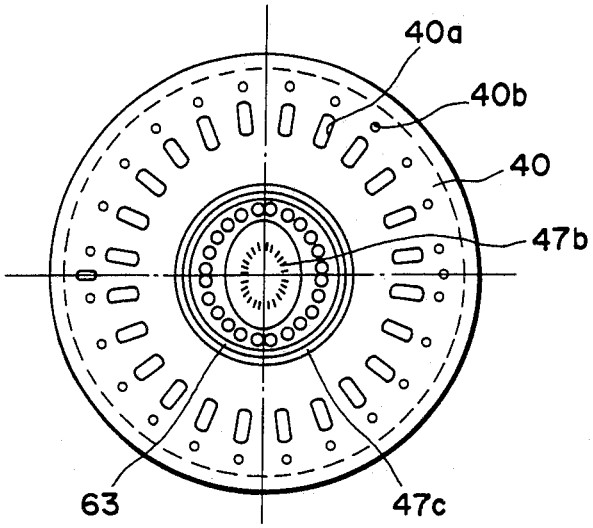
Figure 23:
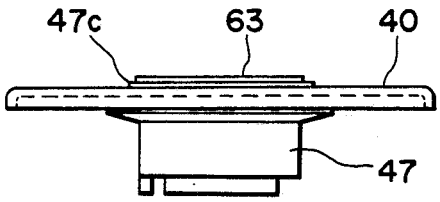

FIGS. 22 and 23 show another embodiment of the present invention. In this embodiment, a ring 63 consisting of elastic rubber is arranged at the side of an outer side surface 47*c* of a subbody 47.

The ring 63 can be fixed by forming a groove in the subbody 47 and pressing it into the groove or by using an adhesive.

When actual printing was performed with the ring 63 of elastic rubber, a noise reduction of about 5 dB was achieved as compared with the conventional printer.

Although the present invention has been described with reference to particular embodiments thereof, it is to be understood that the present invention is not limited thereto. For example, dot matrix printing can be performed, in place of the wire dot matrix printer, with a rotating means on which dot-like projections are formed at the distal ends of armatures. Furthermore, in the embodiments described above, striking is performed by attracting the armatures with the coils. However, striking may also be performed by interrupting current supply to the coils which are normally magnetically attracted.

What is claimed is:

1. A dot matrix printer comprising:

a plurality of pivotal means each having striking means for striking in dot forms and an attraction portion comprising a magnetic material, said pivotal means being arranged in a circle:

attracting means for generating a magnetic force to attract said attraction portion;

a yoke for conveying the magnetic force generated by said attracting means to said attraction portion, said yoke having a center, and having a plurality of first holes arranged in a circle for receiving said attraction portions to be fitted therein and a second hole at the yoke center;

frame means comprising an elastic member fitting said second hole of said yoke integrally therewith for abutting against said pivotal means upon pivotal movement thereof to regulate a stop position of said pivotal means, said frame means having a plurality of first guide holes for guiding said striking means through said second hole;

first cover means having a plurality of second guide holes for guiding the distal end portion of said striking means guided by said first guide holes to a print position; and second cover means cooperating with said first cover means for covering said pivotal means, said attracting means, said yoke, and said frame means.

2. A dot matrix printer according to claim 1, wherein said striking means includes wires and said second guide holes of said first cover means guide said wires to converge toward print position.

3. A dot matrix printer comprising:

a main yoke having substantially a cup shape and having at the inner side thereof a plurality of cores each having a coil wound thereon, said cores being arranged substantially in a circle;

an auxiliary yoke abutted against a cylindrical, circumferential portion of said main yoke at the circumference of said auxiliary yoke, said auxiliary yoke having a first opening at the central portion thereof and a plurality of second holes corresponding to said cores around said first opening, and having a periphery projecting in a cylindrical shape toward said main yoke;

a plurality of actuators each having a plunger to be fitted in a respective one of said second holes of said auxiliary yoke upon attraction by a respective one of said cores; and a plurality of dot impact elements each fixed to one end portion of a respective one of said actuators for striking in response to a pivotal movement of said respective actuator.

4. A dot matrix printer according to claim 3, wherein said auxiliary yoke has inner and outer peripheries of said first opening bent by drawing and projecting in a cylindrical shape toward said main yoke.

5. A dot matrix printer according to claim 3, further comprising holding means formed of a synthetic resin fitting said first opening of said auxiliary yoke to fix it to said main yoke, said holding means having a plurality of guide holes for guiding said dot impact elements.

* * * * *

UNITED STATES PATENT AND TRADEMARK OFFICE

CERTIFICATE OF CORRECTION

PATENT NO. : 4,661,002

DATED : April 28, 1987

INVENTOR(S) : Yoji Ara

It is certified that error appears in the above-identified patent and that said Letters Patent is hereby corrected as shown below:

AT [30] IN THE FOREIGN APPL. PRIORITY DATA

"Aug. 19, 1984 [JP]" should read --Aug. 19, 1983 [JP]--;
"Aug. 19, 1984 [JP]" should read --Aug. 19, 1983 [JP]--;
"Aug. 19, 1984 [JP]" should read --Aug. 19, 1983 [JP]--;
"Aug. 19, 1983 [JP]" should read --Aug. 19, 1983 [JP]--.

COLUMN 2

Line 15, "holer" should read --holder--.

COLUMN 3

Line 2, "extermely" should read --extremely--.
Line 40, "$t_p 2tl/(D_0-D_1)$ (4)" should read --$t_p=2tl/(D_0-D_1)$ (4)--.
Line 45, "$G_2=G_1 t_p$ (5)" should read --$G_2=G_1-t_p$ (5)--.
Line 47, "gap to" should read --gap G--.
Line 55, "it" should read --is--.

COLUMN 4

Line 32, "In" should read --in--.

UNITED STATES PATENT AND TRADEMARK OFFICE

CERTIFICATE OF CORRECTION

PATENT NO. : 4,661,002

DATED : April 28, 1987

INVENTOR(S) : Yoji Ara

It is certified that error appears in the above-identified patent and that said Letters Patent is hereby corrected as shown below:

COLUMN 5

Line 9, "drawing." should read --drawings.--.
Line 29, "which;" should read --which:--.
Line 67, "pluarlity" should read --plurality--.

COLUMN 6

Line 5, "(polybutyrene" should read --(polybutylene--.
Line 17, "surace" should read --surface--.
Line 32, "heatresistant" should read --heat-resistant--.

COLUMN 7

Line 37, "temperature" should read --temperatures--.
Line 40, "oile" should read --oil--.
Line 61, "armature 43" should read --armatures 43--.

COLUMN 8

Line 6, "stell" should read --steel--.
Line 54, "is drawn by" should read -- has --.

UNITED STATES PATENT AND TRADEMARK OFFICE

CERTIFICATE OF CORRECTION

PATENT NO. : 4,661,002

DATED : April 28, 1987

INVENTOR(S) : Yoji Ara

It is certified that error appears in the above-identified patent and that said Letters Patent is hereby corrected as shown below:

COLUMN 9

Line 59, "armature 43" should read --armatures 43--.

COLUMN 10

Line 13, "invnetion" should read --invention--.

Signed and Sealed this

Twenty-fourth Day of October, 1989

*Attest:*

DONALD J. QUIGG

*Attesting Officer*

*Commissioner of Patents and Trademarks*